US010172420B2

(12) United States Patent
James

(10) Patent No.: US 10,172,420 B2
(45) Date of Patent: Jan. 8, 2019

(54) GUITAR-SHAPED BLADDER FOR FOOTWEAR

(71) Applicant: NIKE, Inc., Beaverton, OR (US)

(72) Inventor: Dervin A. James, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 59 days.

(21) Appl. No.: 15/383,491

(22) Filed: Dec. 19, 2016

(65) Prior Publication Data

US 2017/0095035 A1 Apr. 6, 2017

Related U.S. Application Data

(63) Continuation of application No. 14/519,835, filed on Oct. 21, 2014, now Pat. No. 9,554,623, which is a (Continued)

(51) Int. Cl.

| | |
|---|---|
| ***A43B 13/20*** | (2006.01) |
| ***A43B 13/18*** | (2006.01) |
| ***A43B 17/03*** | (2006.01) |
| ***A43B 7/32*** | (2006.01) |
| ***A43B 3/00*** | (2006.01) |

(Continued)

(52) U.S. Cl.

CPC ..... *A43B 13/186* (2013.01); *A43B 3/0036* (2013.01); *A43B 7/142* (2013.01); *A43B 7/143* (2013.01); *A43B 7/32* (2013.01); *A43B 13/125* (2013.01); *A43B 13/18* (2013.01); *A43B 13/188* (2013.01); *A43B 13/189* (2013.01); *A43B 13/20* (2013.01); *A43B 13/203* (2013.01); *A43B 13/223* (2013.01); *A43B 17/03* (2013.01)

(58) Field of Classification Search

CPC ..... A43B 13/18; A43B 13/20; A43B 17/00; A43B 17/03; A43B 17/026

USPC ..... 36/28, 29, 88, 3 R, 3 B, 35 R, 35 B, 37

See application file for complete search history.

(56) References Cited

U.S. PATENT DOCUMENTS 508,034 A 11/1893 Moore
1,069,001 A * 7/1913 Guy ..... A43B 7/06 36/29

(Continued)

OTHER PUBLICATIONS

USPTO, Non-Final Office Action for U.S. Appl. No. 14/519,835, dated May 27, 2016.

(Continued)

*Primary Examiner* — Marie D Bays

(74) *Attorney, Agent, or Firm* — Honigman Miller Schwartz and Cohn LLP; Matthew H. Szalach; Jonathan P. O'Brien

(57) ABSTRACT

An article of footwear includes an upper for securing the article of footwear to a wearer. The footwear also includes a sole assembly operatively coupled to the upper. The sole assembly includes a bladder that contains a fluid. The bladder has a posterior portion, an anterior portion, and a middle portion disposed between the posterior and anterior portions. The posterior portion has a heel recess that is approximately coincidental with a center of a heel of the wearer. The middle portion includes a neck chamber that extends between the posterior and anterior portions. The neck chamber is elongate and has a width that is less than both the posterior and anterior portions, and the anterior portion has a plurality of toe recesses that extend generally away from the neck chamber.

20 Claims, 3 Drawing Sheets

Related U.S. Application Data continuation of application No. 13/411,177, filed on Mar. 2, 2012, now Pat. No. 8,914,994.

(51) Int. Cl.

| | |
|---|---|
| ***A43B 7/14*** | (2006.01) |
| ***A43B 13/12*** | (2006.01) |
| ***A43B 13/22*** | (2006.01) |

(56) References Cited

U.S. PATENT DOCUMENTS

| | | | | |
|---|---|---|---|---|
| 2,080,499 | A | 5/1937 | Nathansohn | |
| 2,762,134 | A | 9/1956 | Town | |
| 3,985,853 | A | 10/1976 | Weisberg | |
| D246,486 | S | 11/1977 | Nickel | |
| 4,115,934 | A | 9/1978 | Hall | |
| 4,183,156 | A | 1/1980 | Rudy | |
| 4,219,945 | A | 9/1980 | Rudy | |
| 4,471,538 | A * | 9/1984 | Pomeranz | A43B 13/189 188/322.5 |
| 4,763,426 | A | 8/1988 | Polus et al. | |
| 4,845,861 | A | 7/1989 | Moumdjian | |
| 5,025,575 | A | 6/1991 | Lakic | |
| 5,125,173 | A | 6/1992 | Nagano et al. | |
| 5,175,946 | A | 1/1993 | Tsai | |
| 5,195,257 | A * | 3/1993 | Holcomb | A43B 13/203 36/28 |
| 5,253,435 | A | 10/1993 | Auger et al. | |
| 5,313,717 | A | 5/1994 | Allen et al. | |
| 5,343,638 | A | 9/1994 | Legassie et al. | |
| 5,353,525 | A | 10/1994 | Grim | |
| 5,363,570 | A | 11/1994 | Allen et al. | |
| 5,406,661 | A | 4/1995 | Pekar | |
| 5,446,977 | A | 9/1995 | Nagano et al. | |
| 5,558,395 | A | 9/1996 | Huang | |
| 5,669,161 | A | 9/1997 | Huang | |
| 5,704,137 | A | 1/1998 | Dean et al. | |
| 5,771,606 | A | 6/1998 | Litchfield et al. | |
| 5,806,208 | A | 9/1998 | French | |
| 5,878,510 | A * | 3/1999 | Schoesler | A43B 7/147 36/153 |
| 5,896,682 | A | 4/1999 | Lin | |
| 6,014,823 | A | 1/2000 | Lakic | |
| 6,178,663 | B1 | 1/2001 | Schoesler | |
| 6,505,420 | B1 | 1/2003 | Litchfield et al. | |
| 6,745,499 | B2 | 6/2004 | Christensen et al. | |
| 6,754,981 | B1 | 6/2004 | Edwards | |
| 6,785,985 | B2 | 9/2004 | Marvin et al. | |
| 7,181,867 | B2 | 2/2007 | Litchfield et al. | |
| 7,278,226 | B2 | 10/2007 | Holden et al. | |
| 7,380,351 | B1 | 6/2008 | Pavone et al. | |
| 7,383,648 | B1 | 6/2008 | Litchfield et al. | |
| 7,395,615 | B2 | 7/2008 | Lee | |
| 8,914,994 | B2 | 12/2014 | James | |
| 9,554,623 | B2 * | 1/2017 | James | A43B 13/20 |
| 2003/0101619 | A1 | 6/2003 | Litchfield et al. | |
| 2003/0172549 | A1 | 9/2003 | Soren | |
| 2003/0217484 | A1 | 11/2003 | Christensen et al. | |
| 2005/0132617 | A1 | 6/2005 | Potter et al. | |
| 2011/0277346 | A1 | 11/2011 | Peyton et al. | |

OTHER PUBLICATIONS

USPTO, Non-Final Office Action for U.S. Appl. No. 13/411,177, dated Jun. 16, 2014.

USPTO, Notice of Allowance for U.S. Appl. No. 13/411,177, dated Aug. 28, 2014.

* cited by examiner

GUITAR-SHAPED BLADDER FOR FOOTWEAR

CROSS-REFERENCE TO RELATED APPLICATIONS

This application is a continuation of U.S. patent application Ser. No. 14/519,835, filed Oct. 21, 2014, which is a continuation of U.S. patent application Ser. No. 13/411,177, filed Mar. 2, 2012, the disclosures of which are hereby incorporated by reference in their entirety.

FIELD

The present disclosure relates to footwear and, more particularly, relates to a guitar-shaped bladder for an article of footwear.

BACKGROUND

Articles of footwear usually include an upper, a midsole, and an outsole. The upper can include sections of thin material, straps, or the like for securing the footwear to the wearer's foot. The outsole is typically a unitary piece of relatively high-friction material that provides traction for the footwear. Also, the midsole can include foam for providing cushioned support for the wearer.

In some cases, the midsole can even include a bladder that contains a fluid, such as a gas or gel. The weight of the wearer and other loading on the bladder causes the fluid to displace within the bladder. As such, the bladder can more easily resiliently deform and/or more easily conform to the wearer's foot than some midsoles made entirely out of foam. Thus, the midsole can provide improved resiliency for better support of the wearer's foot. Also, the footwear can be more comfortable to wear.

Although conventional footwear with bladders have been adequate for their intended purposes, they do suffer from certain disadvantages. For instance, many bladders include relatively wide, open cavities. Thus, fluid within the cavity flows unimpeded toward lower pressure areas when a load is applied to the bladder. As such, the fluid may be displaced so that it is not providing adequate support for the wearer.

Also, these bladders are often blocked from view by either the outsole or foam material of the midsole. As such, the wearer may not be aware that the footwear includes a bladder. Also, the bladder is unlikely to improve the aesthetics of the footwear. In some cases, the foam material of the midsole and/or the outsole includes an opening so that the bladder is visually exposed. However, the opening is typically small, and only a portion of the bladder can be viewed. Also, in these types of footwear, the bladder is typically unadorned or aesthetically dull. Thus, the footwear is not likely to be improved aesthetically by the bladder.

SUMMARY

Accordingly, despite the improvements of known devices described above, there remains a need for an article of footwear that includes an upper for securing the article of footwear to a wearer. The footwear also includes a sole assembly operatively coupled to the upper. The sole assembly includes a bladder that contains a fluid. The bladder has a posterior portion, an anterior portion, and a middle portion disposed between the posterior and anterior portions. The posterior portion has a heel recess that is approximately coincidental with a center of a heel of the wearer. The middle portion includes a neck chamber that extends between the posterior and anterior portions. The neck chamber is elongate and has a width that is less than both the posterior and anterior portions, and the anterior portion has a plurality of toe recesses that extend generally away from the neck chamber.

In another aspect, an article of footwear is disclosed that includes an upper for securing the article of footwear to a wearer. The footwear also includes a sole assembly, which is operatively coupled to the upper. The sole assembly includes a bladder that contains a fluid. The bladder includes a first, second, and third layer that overlap each other. The first and second layers are coupled together to define a first chamber, and the second and third layers are coupled together to define a second chamber. The first chamber directs flow of the fluids therein generally in a first direction, and the second chamber directs flow of the fluid therein generally in a second direction that is transverse to the first direction.

In still another aspect, an article of footwear is disclosed that includes an upper for securing the article of footwear to a wearer. The footwear also includes an outsole and a midsole coupled to and disposed between the upper and the outsole. The midsole includes a bladder that contains a fluid. Also, the bladder includes a plurality of layers that are welded together to define a plurality of weldments arranged in a guitar-shaped pattern. The bladder has a guitar sound-box-shaped posterior portion, a guitar head-shaped anterior portion, and a middle portion disposed between the posterior and anterior portions. The posterior portion has a heel recess that is approximately coincidental with a center of a heel of the wearer. The middle portion contains a guitar neck-shaped neck chamber that extends between and fluidly couples the posterior and anterior portions. In addition, the middle portion further includes a medial chamber and a lateral chamber disposed on opposite sides of the neck chamber. The anterior portion has a plurality of toe recesses that extend generally away from the neck chamber.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
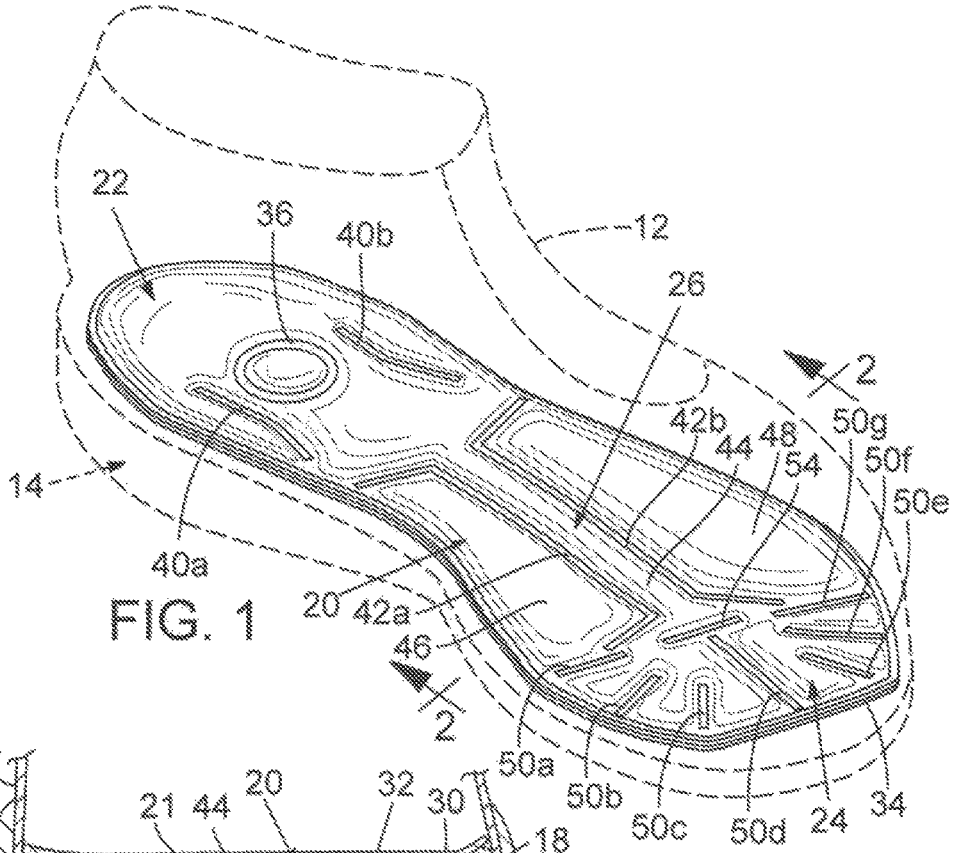
FIG. 1 is a perspective view of an article of footwear with an exemplary embodiment of a bladder according to various teachings of the present disclosure.
Figure 2:
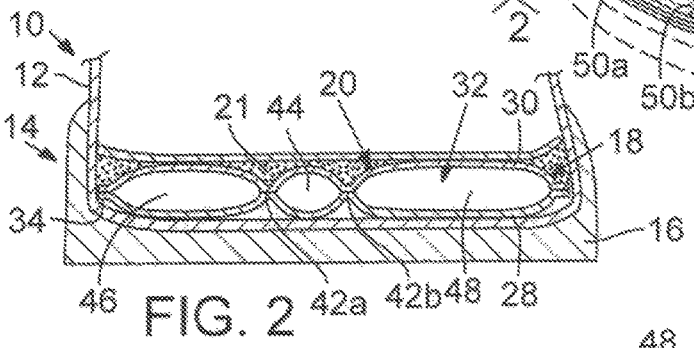
FIG. 2 is a sectional view of the article of footwear taken along the line 2-2 of FIG. 1.

Referring initially to FIGS. 1 and 2, an exemplary embodiment of an article of footwear 10 is illustrated according to various teachings of the present disclosure. Generally, the article of footwear 10 includes an upper 12 and a sole assembly 14. (The upper 12 is shown in phantom in FIG. 1 and shown partially in FIG. 2. Also, the sole assembly 14 is shown partially in phantom in FIG. 1.) The sole assembly 14 is operatively coupled to the upper 12 and can include an outsole 16 and a midsole 18. Furthermore, the midsole 18 can include a bladder 20, which will be discussed in greater detail below.

In some embodiments, the upper 12 can include various thin sections of material that partially overlap each other and that are operably secured to each other, for example, by stitching, adhesives, and the like. The upper 12 can define a cavity that receives a foot 13 of a wearer (see FIG. 4). The upper 12 can also include a fastening structure, such as laces, buckles, pile tape, and/or other features for tightly securing the upper 12 to the wearer's foot 13. It will also be appreciated that the upper 12 can include various decorative features for aesthetically enhancing the footwear 10. Furthermore, it will be appreciated that the upper 12 can substantially cover the entire foot 13, such as a traditional shoe or boot, or the upper 12 can partially cover the foot 13, such as a sandal, etc. without departing from the scope of the present disclosure.

As shown in FIG. 2, the outsole 16 can include a layer of material that covers the outer, bottom and transverse side portions of the footwear 10. The outsole 16 can be secured to the midsole 18 and/or the upper 12 in any suitable fashion, such as adhesives. The outsole 16 can be made of relatively high friction material and can include various grooves, recesses, projections, indentations or other features for improving traction of the footwear 10.

Moreover, as shown in FIG. 2, the midsole 18 can be coupled to and disposed between the upper 12 and the outsole 16. The midsole 18 can include a foam material 21 that is disposed between the outsole 16 and the upper 12. The bladder 20 can be embedded within the foam material 21.

Figure 3:
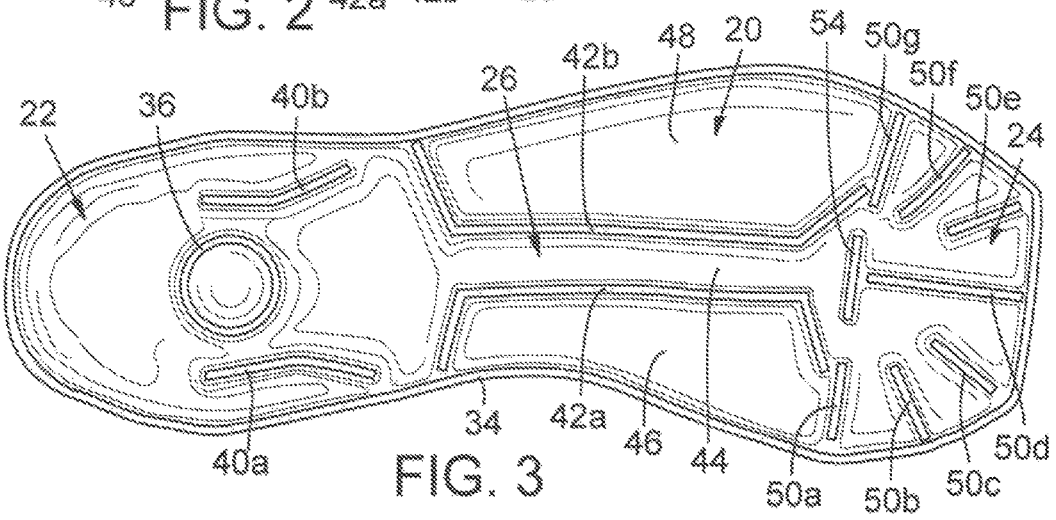
FIG. 3 is a plan view of the bladder of FIG. 1.
Figure 4:
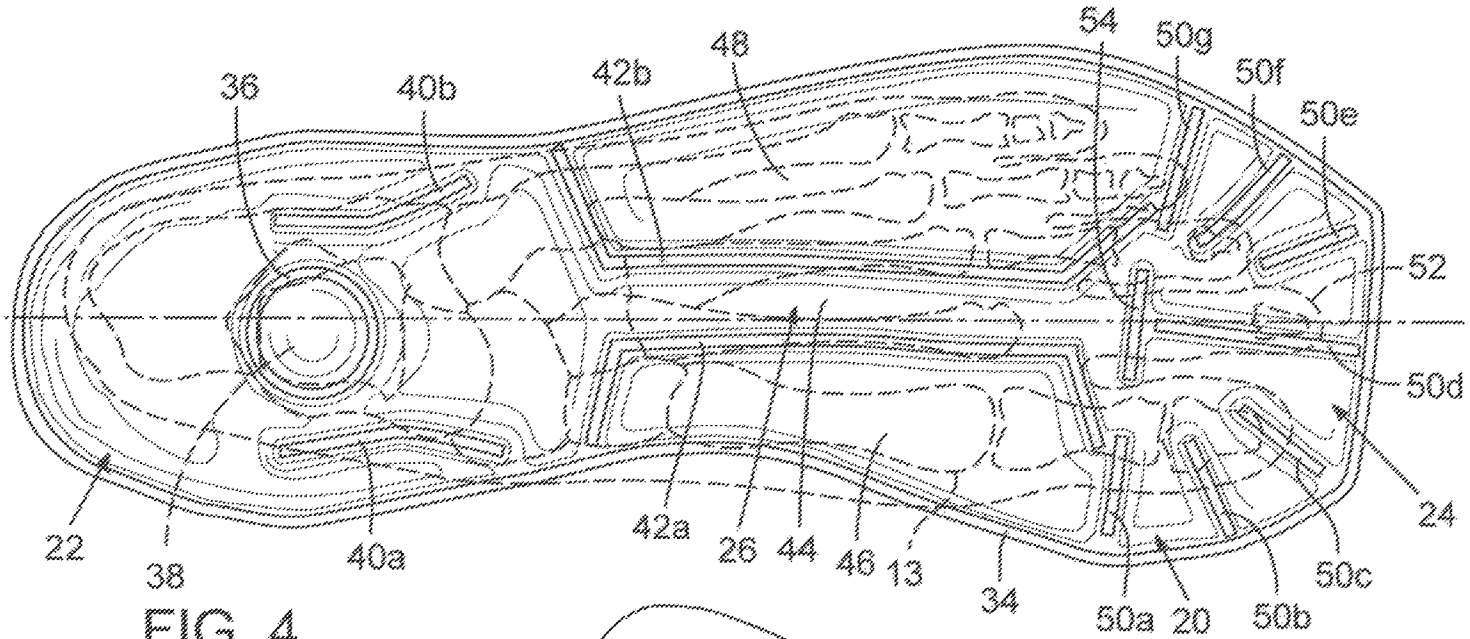
FIG. 4 is a plan view of the bladder of FIG. 1 with a foot of a wearer shown in phantom thereon.

As shown in FIGS. 1, 3, and 4, the bladder 20 can span across substantially the entire sole assembly 14 of the footwear 10. Thus, the bladder 20 can generally include a posterior portion 22, an anterior portion 24, and a middle portion 26 disposed between the posterior and anterior portions 22, 24.

Figure 5:
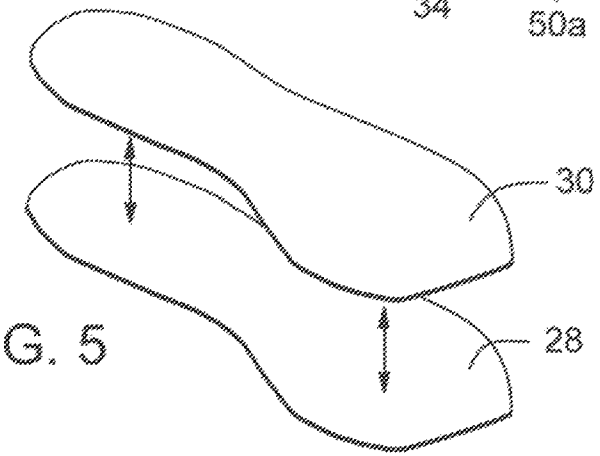
FIG. 5 is an exploded, perspective view of the bladder of FIG. 1.

As shown in FIGS. 2 and 5, the bladder 20 can include a first layer 28 and a second layer 30. The layers 28, 30 can be made out of any suitable material, such as thermoplastic polyurethane (TPU). Another suitable material is a flexible microlayer membrane that includes alternating layers of a gas barrier material and an elastomeric material, as disclosed in U.S. Pat. Nos. 6,082,025 and 6,127,026 to Bonk et al., both hereby incorporated by reference in their entirety. The layers 28, 30 at least partially overlap each other and are coupled together to define at least one enclosed chamber 32 therebetween. A fluid, such as gas or gel can be contained within the chamber 32. The fluid can be of any suitable type, such as nitrogen gas. Thus, the fluid can flow within the bladder 20 and can provide resilient support for the wearer's foot 13 as will be described.

As shown in FIG. 5, the first and second layers 28, 30 can be substantially identical and can entirely overlap each other. The layers 28, 30 can be coupled in any suitable manner. For instance, the layers 28, 30 can be welded together (e.g., contact plastic welding) such that the layers 28, 30 are joined at certain locations (e.g., weldments) and are separated apart at other locations to define the chamber 32 between the layers 28, 30. It will be appreciated that the layers 28, 30 can be joined to thereby hermetically seal the chamber 32.

Also, as will be discussed, the bladder 20 can be formed so as to generally resemble another object. For instance, the bladder 20 can be formed generally in the shape and appearance of a guitar. For example, areas in which the first and second layers 28, 30 are joined can be arranged in a pattern to resemble the shape of a guitar. Also, graphical elements representing strings, frets, and the like and/or other features could be included to further make the bladder 20 resemble a guitar. Moreover, the outsole 16 can be made out of a transparent material so as to visually expose the bladder 20. Accordingly, the footwear 10 can be very aesthetically pleasing.

Specifically, as shown in FIGS. 1-4, the layers 28, 30 can be coupled to define a peripheral weldment 34. Thus, the first and second layers 28, 30 can be joined about the entire respective peripheries at the peripheral weldment 34. Also, the peripheral weldment 34 can extend continuously about the posterior portion 22, the middle portion 26, and the anterior portion 24 of the bladder 20. Thus, the peripheral weldment 34 can significantly match that of an outer periphery of the footwear 10.

Also, the posterior portion 22 of the bladder 20 can include a heel recess weldment 36. As shown in FIGS. 1, 3 and 4, the heel recess weldment 36 can be in the shape of a continuous loop. For instance, the heel recess weldment 36 can be a circular shape. Also, a portion of the fluid within the bladder 20 can be contained within the heel recess weldment 36. As shown in FIG. 4, the heel recess weldment 36 can be approximately coincidental with a center of a heel 38 of the wearer. As such, the heel 38 of the wearer can be substantially received and retained within the heel recess weldment 36, and the wearer's foot 13 is more likely to remain stationary within the footwear 10 for improved support.

The posterior portion 22 can also include a plurality of inner weldments 40*a*, 40*b*. The inner weldments 40*a*, 40*b* can be non-linear and elongate and disposed on opposite sides of the heel recess weldment 36. Also, the inner weldments 40*a*, 40*b* can curve inwardly from the peripheral weldment 34 generally toward the heel recess weldment 36.

Thus, the heel recess weldment 36 can resembles a guitar soundhole, and the inner weldments 40*a*, 40*b* can resemble an hourglass-like shape of a soundbox of a guitar. Thus, the posterior portion 22 of the bladder 20 can substantially resemble a guitar sound box.

Additionally, the middle portion 26 of the bladder 20 can include a plurality of neck weldments 42*a*, 42*b*. The neck weldments 42*a*, 42*b* can be each elongate and can curve inwardly from the peripheral weldment 34 generally toward an axis of the bladder 20. Also, the neck weldments 42*a*, 42*b* are spaced apart such that a neck chamber 44 is defined between the neck weldments 42*a*, 42*b*. Thus, the neck chamber 44 extends longitudinally between the posterior and anterior portions 22, 24 of the bladder 20. Also, the neck chamber 44 can fluidly connect the posterior and anterior portions 22, 24 of the bladder 20. Accordingly, fluid within the bladder 20 can flow between the posterior and anterior portions 22, 24 (i.e., the fluid can flow in a posterior-anterior direction). The neck weldments 42*a*, 42*b* can direct such flow of the fluid and can be adapted to provide a desired pressure distribution in the bladder 20. Accordingly, the bladder 20 can provide improved support for the wearer. Moreover, the neck chamber 44 can be elongate, can have a straight axis, and can have a width that is significantly less than both the posterior and anterior portions 22, 24. As such, the neck chamber 44 can have a shape that resembles a guitar neck.

The middle portion 26 can also include a medial chamber 46 and a lateral chamber 48. The medial and lateral chambers 46, 48 can be disposed on opposite sides of the neck chamber 44 and can be defined between the peripheral weldment 34 and respective ones of the neck weldments 42*a*, 42*b*. In some embodiments, the medial and lateral chambers 46, 48 can be fluidly disconnected from the neck chamber 44. The medial chamber 46 can provide support for the arch of the foot 13, and the lateral chamber 48 can provide support for the lateral portion of the foot.

In addition, the anterior portion 24 of the bladder 20 can include a plurality of toe recess weldments 50*a*-50*g*. The toe recess weldments 50*a*-50*g* can each have a straight axis and can extend generally from the peripheral weldment 34 toward the axis of the bladder 20. Also, the toe recess weldments 50*a*-50*g* can be spaced apart from each other and can each extend or radiate generally away from the respective end of the neck chamber 44. As shown in FIG. 4, one or more of the toe recess weldments 50*a*-50*g* can receive one or more toes 52 of the wearer. For instance, the toe recess weldment 50*d* can receive a second toe 52 of the wearer. Also, the toe recess weldments 50*a*, 50*b*, 50*c* can receive a portion of the big toe 52 of the wearer. Accordingly, the toe recess weldments 50*a*-50*g* can receive and retain one or more toes 52 in a stationary position for increased comfort. Also, because the toe recess weldments 50 extend generally away from the respective end of the neck chamber 44, the toe recess weldments 50 can substantially resemble a head of a guitar.

The anterior portion 24 can also include an end weldment 54 that extends in the medial/lateral direction of the bladder 20. The end weldment 54 can be disposed substantially adjacent the respective end of the neck chamber 44. The end weldment 54 can direct flow of the fluid in the neck chamber 44 toward the medial and lateral directions.

As described above, the bladder 20 can be arranged to sufficiently resemble a guitar for improving the aesthetics of the footwear 10. At the same time, the various features of the bladder 20 can allow for improved comfort for the wearer because the bladder 20 includes various chambers that direct fluid flow within the bladder 20 to provide improved support.

It will be appreciated that the various weldments of the bladder 20 can have any suitable shape other than that shown in FIGS. 1-4. For instance, the weldments can be localized, rounded spot weldments without departing from the scope of the present disclosure. Also, it will be appreciated that the outsole 16 could include features that further enhance the resemblance to a guitar. For instance, the outsole 16 could be transparent such that the bladder 20 is visible. The outsole 16 can also include grooves that match the shape(s) of the bladder 20. Furthermore, the outsole 16 can include graphical elements indicative of a guitar.

Figure 6:
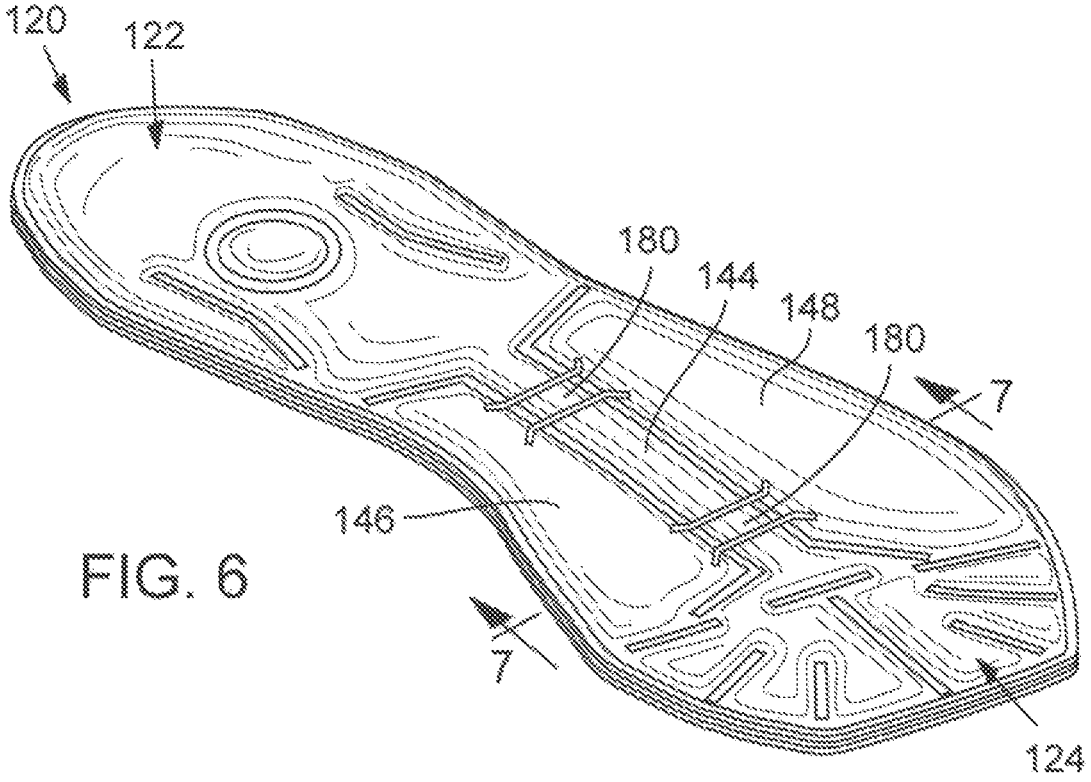
FIG. 6 is a perspective view of another exemplary embodiment of the bladder.
Figure 7:
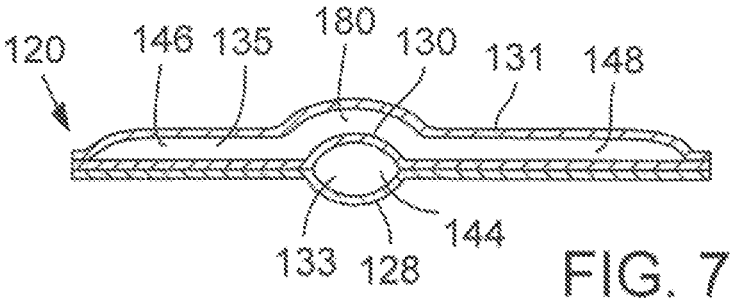
FIG. 7 is a sectional view of the bladder taken along the line 7-7 of FIG. 6.

Now referring to FIGS. 6 and 7, another exemplary embodiment of the bladder 120 is illustrated. Components that are similar to the embodiment of FIGS. 1-5 are indicated with similar reference numerals increased by 100.

As shown, the bladder 120 includes a first layer 128, a second layer 130, and a third layer 131 which overlap each other and are coupled to together, such as via a welding process. As shown in FIG. 7, the first and second layers 128, 130 are coupled to define a first chamber 133. The first chamber 133 can be configured to define the posterior portion 122, the anterior portion 124, and the neck chamber 144. Also, the second and third layers 130, 131 are coupled to define a second chamber 135 therebetween. The second chamber 135 can be configured so as to define the medial chamber 146 and the lateral chamber 148. The first and second chambers 133, 135 can be fluidly disconnected from each other.

Also, as shown in FIGS. 6 and 7, the bladder 120 can include one or more valves 180. The valves 180 can be defined between the second and third layers 130, 131 as shown in FIG. 7. The valves 180 can extend across and bypass the neck chamber 144 to thereby fluidly couple the medial and lateral chambers 146, 148. Thus, fluid within the first chamber 133 can flow substantially in an anterior-posterior direction through the neck chamber 144. Also, fluid in the second chamber 135 can independently flow in a medial-lateral direction between the medial and lateral chambers 146, 148 through the valves 180. Thus, the pressure distribution and fluid flow within the bladder 120 can be different depending on the location within the bladder 120. Accordingly, the bladder 120 is more likely to properly support the wearer. In addition, like the embodiment of FIGS. 1-5, the bladder 120 can be formed so as to substantially resemble a guitar or other object to improve the aesthetics of the footwear.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

I claim:

1. A sole assembly for an article of footwear, the sole assembly comprising:

a bladder including a posterior portion, an anterior portion, and a middle portion disposed between the posterior portion and the anterior portion, the posterior portion having a heel weldment that forms a continuous loop and a pair of nonlinear elongate inner weldments disposed on opposite sides of the heel weldment, the middle portion including an elongate neck chamber extending between the posterior portion and the anterior portion and having a width that is less than both the posterior portion and the anterior portion.

2. The sole assembly of claim 1, wherein the anterior portion includes a plurality of toe recesses.

3. The sole assembly of claim 2, wherein the plurality of toe recesses radiate away from a distal end of the neck chamber.

4. The sole assembly of claim 3, wherein the plurality of toe recesses extend away from a longitudinal axis of the bladder.

5. The sole assembly of claim 2, wherein the bladder includes a plurality of sheets that at least partially overlap and that are welded together at the plurality of toe recesses to define a plurality of toe weldments.

6. The sole assembly of claim 5, wherein the plurality of toe weldments each have a straight axis.

7. The sole assembly of claim 1, wherein the bladder includes a plurality of sheets that at least partially overlap and that are welded together, the plurality of sheets being welded together at the heel weldment to form the continuous loop.

8. The sole assembly of claim 1, wherein the continuous loop forms a heel recess in the bladder having a circular shape.

9. The sole assembly of claim 1, wherein the neck chamber fluidly connects the anterior portion and the posterior portion.

10. An article of footwear incorporating the sole assembly of claim 1.

11. A sole assembly for an article of footwear, the sole assembly comprising:

a bladder including a posterior portion having a heel weldment that contains a volume of fluid and forms a heel recess, an anterior portion that partially defines an outer periphery of the bladder and includes a plurality of elongate to recesses extending radially to the outer periphery, and a middle portion disposed between the posterior portion and the anterior portion, the middle portion including an elongate neck chamber extending between the posterior portion and the anterior portion and having a width that is less than both the posterior portion and the anterior portion.

12. The sole assembly of claim 11, wherein the plurality of toe recesses radiate away from a distal end of the neck chamber.

13. The sole assembly of claim 12, wherein the plurality of toe recesses extend away from a longitudinal axis of the bladder.

14. The sole assembly of claim 11, wherein the bladder includes a plurality of sheets that at least partially overlap and that are welded together at the plurality of toe recesses to define a plurality of toe weldments.

15. The sole assembly of claim 14, wherein the plurality of toe weldments each have a straight axis.

16. The sole assembly of claim 11, wherein the bladder includes a plurality of sheets that at least partially overlap and that are welded together, the plurality of sheets being welded together at the heel weldment to form the heel recess.

17. The sole assembly of claim 11, wherein the heel weldment forms a continuous, circular loop.

18. The sole assembly of claim 11, wherein the neck chamber fluidly connects the anterior portion and the posterior portion.

19. An article of footwear incorporating the sole assembly of claim 11.

20. The sole assembly of claim 11, wherein the posterior portion includes a pair of nonlinear elongate inner weldments disposed on opposite sides of the heel weldment.

* * * * *